US011694838B2

(12) United States Patent
Kim et al.

(10) Patent No.: US 11,694,838 B2
(45) Date of Patent: Jul. 4, 2023

(54) COIL ELECTRONIC COMPONENT

(71) Applicant: SAMSUNG ELECTRO-MECHANICS CO., LTD., Suwon-si (KR)

(72) Inventors: Yong Min Kim, Suwon-si (KR); Jae Hun Kim, Suwon-si (KR); Ji Hyuk Lim, Suwon-si (KR); Jong Yun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 754 days.

(21) Appl. No.: 16/696,651

(22) Filed: Nov. 26, 2019

(65) Prior Publication Data

US 2020/0402704 A1 Dec. 24, 2020

(30) Foreign Application Priority Data

Jun. 21, 2019 (KR) ..... 10-2019-0073985

(51) Int. Cl.
*H01F 17/04* (2006.01)
*H01F 27/06* (2006.01)
(Continued)

(52) U.S. Cl.
CPC ..... *H01F 27/2828* (2013.01); *H01F 27/292* (2013.01); *H01F 27/327* (2013.01)

(58) Field of Classification Search
CPC .. H01F 17/04; H01F 17/0013; H01F 17/0033; H01F 27/06; H01F 27/28;
(Continued)

(56) References Cited

U.S. PATENT DOCUMENTS 10,079,089 B1 * 9/2018 Yoon ..... H01F 17/0013
2003/0148558 A1 * 8/2003 Kubo ..... H01L 23/49822 257/E21.582
(Continued)

FOREIGN PATENT DOCUMENTS

KR 10-1481412 B1 1/2015
KR 10-2015-0044372 A 4/2015
(Continued)

OTHER PUBLICATIONS

Office Action issued in corresponding Korean Patent Application No. 10-2019-0073985 dated May 12, 2020, with English translation.

*Primary Examiner* — Xiaoliang Chen
(74) *Attorney, Agent, or Firm* — Morgan, Lewis & Bockius LLP

(57) ABSTRACT

A coil electronic component includes an insulating substrate, a coil portion disposed on at least one surface of the insulating substrate, a body in which the insulating substrate and the coil portion are embedded, a lead-out portion connected to the coil portion and exposed from a surface of the body, and a connection portion including a plurality of connecting conductors each having a bent portion to increase lengths of the plurality of connecting conductors embedded in the body, the plurality of connecting conductors being spaced apart from each other, the connection portion connecting an end of the coil portion to the lead-out portion to each other.

11 Claims, 8 Drawing Sheets

(51) Int. Cl.

| | |
|---|---|
| ***H01F 27/28*** | (2006.01) |
| ***H01F 27/29*** | (2006.01) |
| ***H01F 27/255*** | (2006.01) |
| ***H01F 41/04*** | (2006.01) |
| ***H01F 41/10*** | (2006.01) |
| ***H01F 41/12*** | (2006.01) |
| ***H05K 1/18*** | (2006.01) |
| ***H01L 23/498*** | (2006.01) |
| ***H01F 5/00*** | (2006.01) |
| ***H01F 5/04*** | (2006.01) |
| ***H01F 27/32*** | (2006.01) |

(58) Field of Classification Search

CPC ..... H01F 27/29; H01F 27/254; H01F 27/255; H01F 27/292; H01F 27/325; H01F 41/04; H01F 41/10; H01F 41/12; H01F 5/00; H01F 5/04; H05K 1/18; H05K 1/181; H01L 23/498; F01F 5/00

USPC ..... 336/192, 180, 199, 200; 29/602.1, 605, 29/846

See application file for complete search history.

(56) References Cited

U.S. PATENT DOCUMENTS

2012/0154095 A1* 6/2012 Li ..... H01F 27/325 336/199
2013/0169399 A1* 7/2013 Yoo ..... H01F 17/0013 427/125
2013/0314189 A1* 11/2013 Okumura ..... H01F 17/0013 336/192
2015/0028983 A1* 1/2015 Ryu ..... H01F 1/15308 29/846
2015/0102891 A1* 4/2015 Yoon ..... H01F 27/2804 336/200
2016/0172103 A1* 6/2016 Jeong ..... H01F 17/04 29/605
2016/0189840 A1* 6/2016 Ahn ..... H01F 17/04 29/602.1
2016/0189849 A1* 6/2016 Lee ..... H01F 41/10 29/602.1
2016/0225517 A1* 8/2016 Choi ..... H01F 27/292
2016/0314889 A1* 10/2016 Ryu ..... H01F 41/0246
2016/0351315 A1* 12/2016 Park ..... H01F 17/04
2016/0351319 A1* 12/2016 Jeong ..... H01F 17/0033
2017/0040101 A1* 2/2017 Jeong ..... H01F 27/2804
2017/0103847 A1* 4/2017 Park ..... H01F 17/0013
2017/0148560 A1* 5/2017 Yoon ..... H05K 1/181
2017/0162319 A1* 6/2017 Otani ..... H01G 4/008
2017/0178789 A1* 6/2017 Kim ..... H01F 27/324
2017/0178790 A1* 6/2017 Kim ..... H01F 17/04
2017/0243689 A1* 8/2017 Yoon ..... H01F 17/04
2017/0345551 A1* 11/2017 Yoshioka ..... H01F 17/04
2017/0345556 A1* 11/2017 Kim ..... H01F 17/0013
2018/0012700 A1* 1/2018 Lee ..... H01F 17/0013
2018/0019051 A1* 1/2018 Bong ..... H01F 27/327
2018/0047493 A1* 2/2018 Yang ..... H01F 27/29
2018/0075965 A1* 3/2018 Yoshioka ..... H01F 27/292
2018/0096783 A1* 4/2018 Fukuda ..... H01F 27/366
2018/0108475 A1* 4/2018 Hamada ..... H01F 17/00
2018/0114619 A1* 4/2018 Kim ..... H01F 10/06
2018/0122546 A1* 5/2018 Lee ..... H01F 27/24
2018/0174727 A1* 6/2018 Kim ..... H01F 17/0013
2018/0174736 A1* 6/2018 Li ..... H01F 17/0013
2018/0197675 A1* 7/2018 Kido ..... H01F 41/122
2018/0240586 A1* 8/2018 Yoon ..... H01F 17/04
2018/0261377 A1* 9/2018 Kim ..... H01F 27/292
2018/0358171 A1* 12/2018 Jung ..... H01F 17/0013
2019/0013141 A1* 1/2019 Yoon ..... H01F 17/0006
2019/0013145 A1* 1/2019 Ohkubo ..... H01F 17/04
2019/0013148 A1* 1/2019 Ohkubo ..... H01F 17/045
2019/0019616 A1* 1/2019 Cha ..... H01F 41/125
2019/0027288 A1* 1/2019 Sato ..... H01F 38/14
2019/0066905 A1* 2/2019 Hong ..... H01F 41/043
2019/0066908 A1* 2/2019 Ueda ..... H01F 17/0013
2019/0074126 A1* 3/2019 Kim ..... H01F 27/2804
2019/0088402 A1* 3/2019 Kim ..... H01F 27/324
2019/0096568 A1* 3/2019 Yoon ..... H01F 17/0013
2019/0115142 A1* 4/2019 Kim ..... H01F 41/042
2019/0198215 A1* 6/2019 Choi ..... H01F 17/0013
2019/0333684 A1* 10/2019 Li ..... H01F 27/28

FOREIGN PATENT DOCUMENTS

KR 10-2015-0105691 A 9/2015
KR 10-2016-0071958 A 6/2016
KR 10-2016-0081054 A 7/2016
KR 10-2018-0065801 A 6/2018
KR 10-2019-0033765 A 4/2019

* cited by examiner

COIL ELECTRONIC COMPONENT

CROSS-REFERENCE TO RELATED APPLICATION(S)

This application claims the benefit under 35 USC 119(a) of Korean Patent Application No. 10-2019-0073985 filed on Jun. 21, 2019 in the Korean Intellectual Property Office, the entire disclosure of which is incorporated herein by reference for all purposes.

TECHNICAL FIELD BACKGROUND

The present disclosure relates to a coil electronic component.

BACKGROUND

Description of Related Art

Inductors, coil components, are representative passive elements used in electronic devices, together with resistors and capacitors. As electronic devices have been increasingly multifunctionalized and miniaturized, the number of electronic components used in electronic devices has been increasing, while becoming smaller in size.

However, as a thinned coil component is manufactured, external force or the like may be applied to a portion in which the coil portion and the external electrode are connected, thereby reducing connection reliability and structural rigidity between the conductor and the body.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil electronic component in which connection reliability and structural rigidity of a portion in which a coil portion and an external electrode are connected are increased.

According to an aspect of the present disclosure, a coil electronic component includes an insulating substrate, a coil portion disposed on at least one surface of the insulating substrate, a body in which the insulating substrate and the coil portion are embedded, a lead-out portion connected to the coil portion and exposed from a surface of the body, and a connection portion including a plurality of connecting conductors each having a bent portion to increase lengths of the plurality of connecting conductors embedded in the body, the plurality of connecting conductors being spaced apart from each other, the connection portion connecting an end of the coil portion to the lead-out portion to each other.

BRIEF DESCRIPTION OF DRAWINGS

Throughout the drawings and the detailed description, the same reference numerals refer to the same elements. The drawings may not be to scale, and the relative size, proportions, and depictions of elements in the drawings may be exaggerated for clarity, illustration, and convenience.

DETAILED DESCRIPTION

Figure 1:
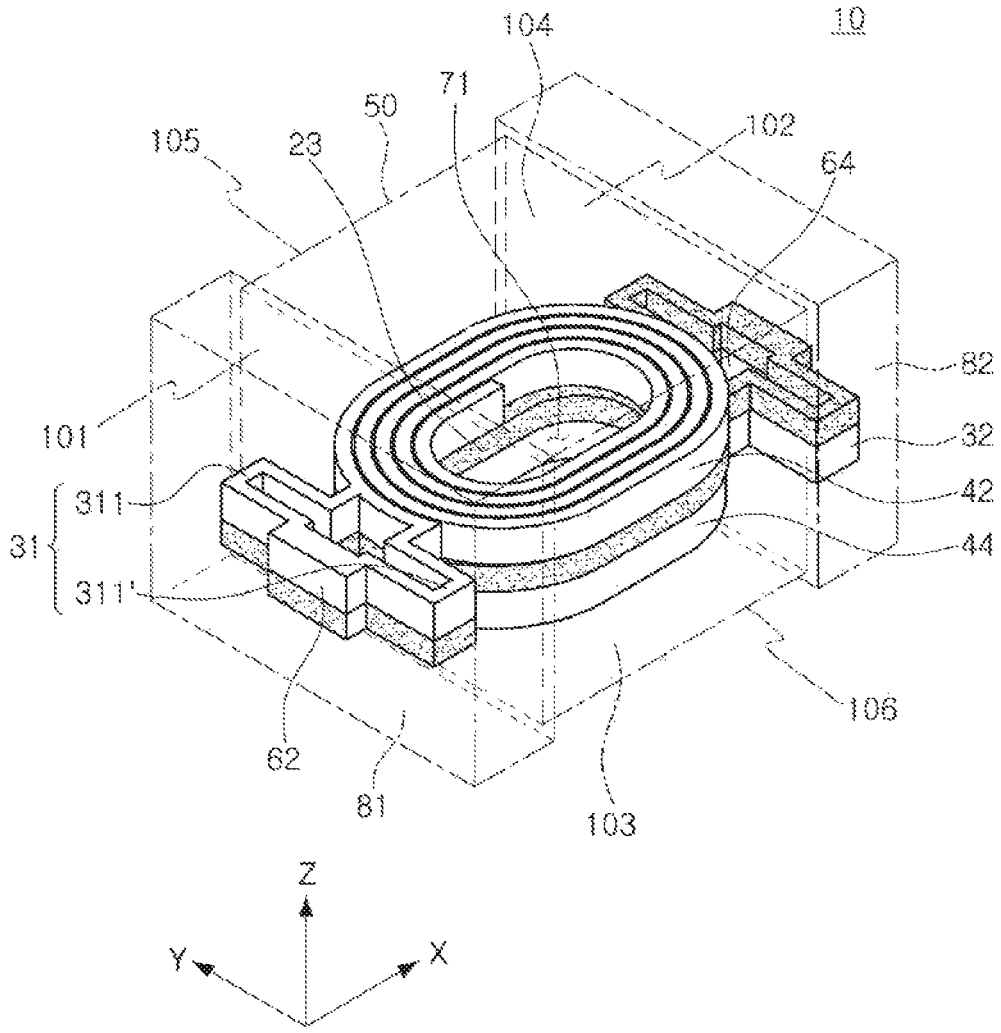
FIG. 1 is a perspective view schematically illustrating a coil electronic component according to a first embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to" another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

The drawings may not be to scale, and the relative size, proportions, and depiction of elements in the drawings may be exaggerated for clarity, illustration, and convenience.

Hereinafter, embodiments of the present disclosure will be described with reference to various embodiments. However, the embodiments of the present disclosure can be modified into various other forms, and the scope of the present disclosure is not limited to the embodiments described below.

In the drawings, the X direction may be defined as a first direction or a length direction, the Y direction as a second direction or a width direction, and the Z direction as a third direction or a thickness direction.

Hereinafter, a coil electronic component according to an embodiment will be described in detail with reference to the accompanying drawings. Referring to the accompanying drawings, the same or corresponding components are denoted by the same reference numerals, and duplicate descriptions thereof will be omitted.

Various kinds of electronic components are used in an electronic device, and various kinds of coil components may be appropriately used between these electronic components, for removal of noise.

For example, in an electronic device, a coil electronic component may be used as a power inductor, a high frequency (HF) inductor, a general bead, a high frequency (GHz) bead, a common mode filter, or the like.

First Embodiment

Figure 2:
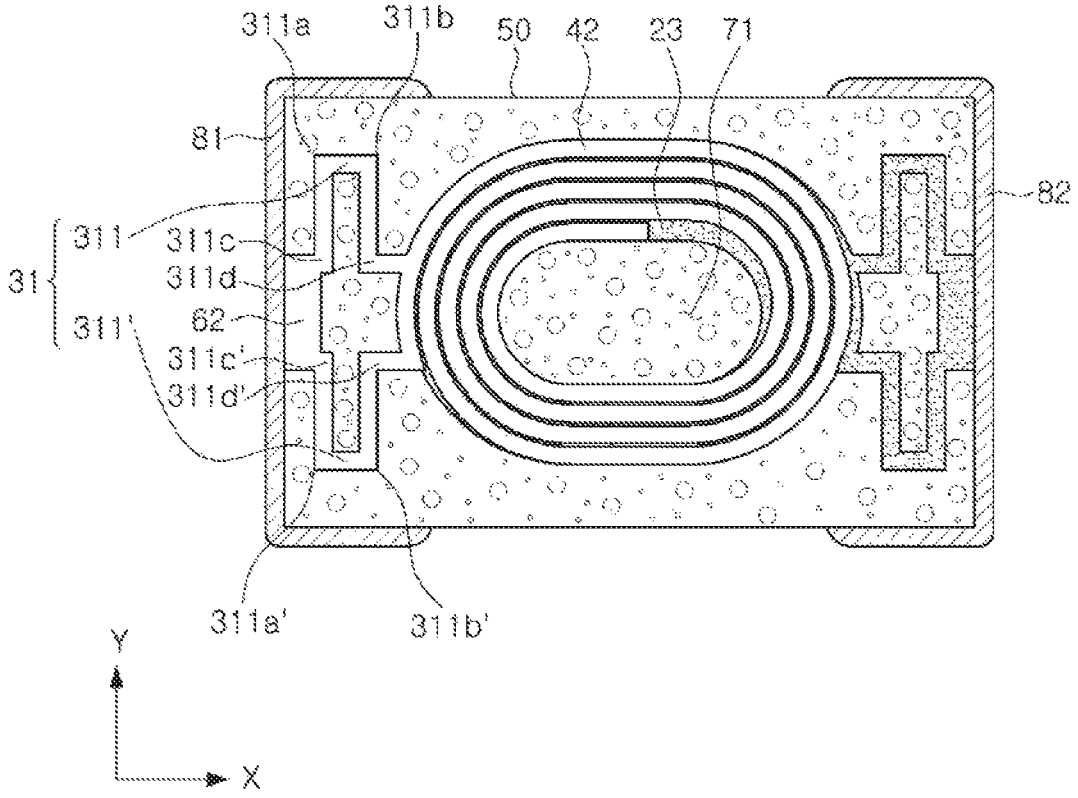
FIG. 2 is a diagram illustrating coil portions of the coil electronic component of FIG. 1, overlapping each other.

FIG. 1 is a perspective view schematically illustrating a coil electronic component according to a first embodiment. FIG. 2 is a diagram illustrating coil portions of the coil electronic component of FIG. 1, overlapping each other.

Referring to FIGS. 1 and 2, a coil electronic component 10 according to a first embodiment may include an insulating substrate 23, coil portions 42 and 44, a body 50, lead-out portions 62 and 64, and connection portions 31 and 32, and may further include external electrodes 81 and 82.

The insulating substrate 23 is disposed inside the body 50 to be described later, and supports the coil portions 42 and 44 and the lead-out portions 62 and 64.

The insulating substrate 23 may be formed of an insulating material including a thermosetting insulating resin such as an epoxy resin, a thermoplastic insulating resin such as polyimide or a photoimageable dielectric resin, or may be formed of an insulating material in which an insulating resin is impregnated with a reinforcing material such as a glass fiber or an inorganic filler. As an example, the insulating substrate 23 may be formed of an insulating material such as prepreg, Ajinomoto Build-up Film (ABF), FR-4, bismaleimide triazine (BT) film, and a Photo Imageable Dielectric (PID) film, or the like, but a material thereof is not limited thereto.

As the inorganic filler, one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$) may be used.

For example, when the insulating substrate 23 is formed of an insulating material including a reinforcing material, the insulating substrate 23 may provide relatively excellent rigidity. When the insulating substrate 23 is formed of an insulating material not containing a glass fiber, the insulating substrate 23 may be advantageous in terms of thinning the thickness of entirety of the coil portions 42 and 44.

The insulating substrate 23 may be provided with a through-hole (not labeled) formed by penetrating through a central portion thereof, and the through-hole (not labeled) may be filled with a magnetic material of the body 50 to be described later to form a core portion 71. As such, by forming the core portion 71 filled with the magnetic material, performance of a thin film inductor may be improved.

The coil portions 42 and 44 are disposed on at least one surface of the insulating substrate 23 to exhibit characteristics of the coil electronic component. For example, when the coil electronic component 10 according to this embodiment is used as a power inductor, the coil portions 42 and 44 may serve to stabilize the power supply of an electronic device by storing an electric field as a magnetic field to maintain an output voltage.

In this embodiment, the coil portions 42 and 44 (a first coil portion 42 and a second coil portion 44) are disposed on both surfaces of the insulating substrate 23 opposing each other, respectively. For example, the first coil portion 42 may be disposed on one surface of the insulating substrate 23 to face the second coil portion 44 disposed on the other surface of the insulating substrate 23, and may be electrically connected to each other through a via electrode (not illustrated). Each of the first coil portion 42 and the second coil portion 44 may have a planar spiral shape in which at least one turn is formed around the core portion 71. For example, the first coil portion 42 may form at least one turn about the core portion 71 as an axis on one surface of the insulating substrate 23.

The body 50 forms the exterior of the coil electronic component 10 according to the embodiment, and includes the insulating substrate 23 and the coil portions 42 and 44 embedded therein.

The body 50 may be formed in the shape of a hexahedron overall.

The body 50 has a first surface 101 and a second surface 102 opposing each other in a length direction X, a third surface 103 and a fourth surface 104 opposing each other in a thickness direction Z, and a fifth surface 105 and a sixth surface 106 opposing each other in a width direction Y, with reference to FIG. 1. The third and fourth surfaces 103 and 104 of the body 50, opposing each other, respectively connect the first and second surfaces 101 and 102 of the body 50, opposing each other.

In the case of the coil electronic component 10 according to an embodiment including the external electrodes 81 and 82 to be described later, by way of example, the body 50 may be formed to have a length of 0.2±0.1 mm, a width of 0.25±0.1 mm, and a thickness of 0.4 mm±0.1 mm, but an embodiment thereof is not limited thereto.

The body 50 may include a magnetic material and an insulating resin. In detail, the body 50 may be formed by laminating one or more magnetic sheets containing an insulating resin and a magnetic material dispersed in the insulating resin. The body 50 may also have a structure other than the structure in which the magnetic material is dispersed in the insulating resin. For example, the body 50 may be formed of a magnetic material such as ferrite.

The magnetic material may be ferrite or a magnetic metal powder. The ferrite powder may be at least one of spinel type ferrites such as Mg—Zn type, Mn—Zn type, Mn—Mg type, Cu—Zn type, Mg—Mn—Sr type, Ni—Zn type and the like, hexagonal ferrites such as Ba—Zn type, Ba—Mg type, Ba—Ni type, Ba—Co type, Ba—Ni—Co type and the like, garnet type ferrites such as a Y system and the like, and Li-based ferrites. In addition, the magnetic metal powder included in the body 50 may include iron (Fe), silicon (Si), chromium (Cr), cobalt (Co), molybdenum (Mo), aluminum (Al), niobium (Nb), copper (Cu), nickel (Ni), and alloys thereof. For example, the magnetic metal powder may be at least one of pure iron powder, an Fe—Si-based alloy powder, an Fe—Si—Al based alloy powder, an Fe—Ni based alloy powder, an Fe—Ni—Mo based alloy powder, an Fe—Ni—Mo—Cu based alloy powder, an Fe—Co based alloy powder, an Fe—Ni—Co based alloy powder, an Fe—Cr based alloy powder, an Fe—Cr—Si based alloy powder, an Fe—Si—Cu—Nb based alloy powder, an Fe—Ni—Cr based alloy powder, and an Fe—Cr—Al based alloy powder. In this case, the magnetic metal powder may be amorphous or crystalline. For example, the magnetic metal powder may be an Fe—Si—B—Cr amorphous alloy powder, but is not limited thereto. The ferrite particle particles and the magnetic metal powder particles may each have an average diameter of about 0.1 μm to 30 μm, but embodiments thereof are not limited thereto.

The body 50 may include two or more kinds of magnetic materials dispersed in an insulating resin. In this case, different kinds of magnetic materials mean that the magnetic materials dispersed in the insulating resin are distinguished from each other by any one of an average diameter, a composition, crystallinity and a shape. The insulating resin may include, but is not limited to, an epoxy, polyimide, a liquid crystal polymer, or the like, alone or in combination, but is not limited thereto.

The lead-out portions 62 and 64 are connected to the coil portions 42 and 44 to be exposed to the surface of the body 50.

Referring to FIG. 1, one end of the first coil portion formed on one surface of the insulating substrate 23 extends to form a first lead-out portion 62, and the first lead-out portion 62 may be exposed to the first surface 101 of the body 50. In addition, one end of the second coil portion 44 extends to the other surface of the insulating substrate 23 opposing one surface of the insulating substrate 23 to form a second lead-out portion 64, and the second lead-out portion 64 may be exposed to the second surface 102 of the body 50.

Referring to FIGS. 1 to 4, the external electrodes 81 and 82 and the coil portions 42 and 44 are connected to each other through the lead-out portions 62 and 64 disposed in the body 50.

The lead-out portions 62 and 64 may include a conductive metal such as copper (Cu) and are integrally formed when the coil portions 42 and 44 are plated.

The connection portions 31 and 32 (first connection portion 31 and second connection portion 32) may be disposed on both surfaces of the insulating substrate 23 to connect ends of the coil portions 42 and 44 and the lead-out portions 62 and 64, respectively. In detail, the first connection portion 31 is disposed on one surface of the insulating substrate 23 to connect the first lead-out portion 62 and the first coil portion 42, and the second connection portion 32 is disposed on the other surface of the insulating substrate 23 opposing the one surface of the insulating substrate 23 to connect the second lead-out portion 64 and the second coil portion 44.

Referring to FIGS. 1 and 2, a bent portion is formed in the connection portions 31 and 32, such that lengths of the connection portions 31 and 32 embedded in the body 50 are increased. For example, the connection portion 31 has a length greater than a distance from the lead-out portion 62 to the coil portion 42 along a straight line, and the connection portion 32 has a length greater than a distance from the lead-out portion 64 to the coil portion 44 along a straight line. If the coil portions 42 and 44 and the external electrodes 81 and 82 are weakly coupled, desorption may occur due to an external shock such as heat or the like during chip manufacturing or utilization. In this case, there is a problem in that electrical resistance is greatly increased or an open defect occurs in a connection region in which the coil portions 42 and 44 and the external electrodes 81 and 82 are connected. Further, as the area of the lead-out portions 62 and 64 exposed to the outside of the body 50 is increased, stress in a subsequent process such as cutting, polishing or the like may be transferred to the coil portions 42 and 44. An influence of such stress may be relatively increased as a thickness of the body 50 is reduced.

In the embodiment of the present disclosure, by disposing the bent portion or the like in the connection portions 31 and 32, a length of the path of the connection portions 31 and 32 embedded in the body 50 may be increased, and even in a case in which the thickness of the body decreases, a detachment phenomenon between the coil portions 42 and 44 and the external electrodes 81 and 82 may be prevented. For example, the structural rigidity between the coil portions 42 and 44 and the external electrodes 81 and may be secured by increasing contact areas of the connection portions 31 and 32 and the body 50. Hereinafter, although the description will be provided based on the first connection portion 31, the same description thereas may be applied to the second connection portion 32. Similarly, although the description will be provided based on a plurality of first connecting conductors 311 and 311', the same description there as may be applied to a plurality of second connecting conductors 321 and 321'.

Referring to FIG. 2, the first connection portion 31 includes a plurality of first connecting conductors 311 and 311' spaced apart from each other. The plurality of first connecting conductors 311 and 311' respectively connect an end of the first coil portion 42 and the first lead-out portion 62. In this case, connection reliability between the coil portions 42 and 44 and the external electrodes 81 and 82 may be improved as compared with the structure in which the first connection portion 31 is formed of a single connecting conductor. As an example, since the first coil portion 42 and the first external electrode 81 are connected to each other by a plurality of connecting conductors 311 and 311', spaced apart from each other, even in a case in which any one, for example, 311, of the plurality of first connecting conductors 311 and 311' is damaged, electrical and physical connections between the first coil portion 42 and the first external electrode 81 may be maintained through the remaining connecting conductor 311'. In addition, a magnetic material of the body 50 is additionally disposed in a region spaced between the plurality of first connecting conductors 311 and 311' and a region spaced between the plurality of second connecting conductors 312 and 312', thereby further securing inductance. In one example, a portion of the insulating substrate 23 on which the first connection portion 31 may have a shape corresponding to the first connection portion 31, and a portion of the insulating substrate 23 on which the second connection portion 32 may have a shape corresponding to the second connection portion 32. In this case, a magnetic material of the body 50 may be also disposed in a hole in the insulating substrate 23 corresponding to the region spaced between the plurality of first connecting conductors 311 and 311'. A magnetic material of the body 50 may be also disposed in another hole in the insulating substrate 23 corresponding to the region spaced between the plurality of second connecting conductors 312 and 312'.

Referring to FIG. 2, the plurality of first connecting conductors 311 and 311' may have at least one or more bent portions and may have at least one or more corner portions formed by the bent portions. As an example, the first connecting conductor 311 have first to fourth bent portions 311*a*, 311*b*, 311*c* and 311*d*, to have corners formed by the first to fourth bent portions 311*a*, 311*b*, 311*c* and 311*d*.

The bent portions of the plurality of connecting conductors 311 and 311' may be disposed in positions to correspond to each other, respectively. As an example, since the first connecting conductor 311 and the first connecting conductor 311' are disposed to correspond to each other, the bent portions of the first connecting conductor 311 and the first connecting conductor 311' are also formed to correspond to each other. The first bent portion 311*a* of the first connecting conductor 311 corresponds to a first bent portion 311*a'* of the first connecting conductor 311', to be symmetrical to each other, and similarly, the second to fourth bent portions 311*b*, 311*b'*, 311*c*, 311*c'*, 311*d* and 311*d'* may also be formed in positions corresponding to each other of the first connecting conductors 311 and 311', respectively.

Although the shape of the plurality of connecting conductors 311 and 311' constituting the connection portion 31 is not particularly limited, a symmetrical shape may be used to secure structural rigidity between the coil portions 42 and 44 and the external electrodes 81 and 82. As an example, the first connecting conductors 311 and 311' may be formed to have a symmetric cross-shape formed by the third bent portions 311*c* and 311*c'*, the first bent portions 311*a* and 311*a'*, the second bent portions 311*b* and 311*b'*, and the fourth bent portions 311*d* and 311*d'*.

As viewed in a width direction Y, a distance between the first bent portions 311*a* and 311*a'* is substantially the same as a distance between the second bent portions 311*b* and 311*b'*, and a distance between the third bent portions 311*c* and 311*c'* may be substantially the same as a distance between the fourth bent portions 311*d* and 311*d'*. In this case, a distance between the first bent portions 311*a* and 311*a'* and the second bent portions 311*b* and 311*b'* may be greater than a distance between the third bent portions 311*c* and 311*c'* and the fourth bent portions 311*d* and 311*d'*, respectively. As such, respective lengths of the first connecting conductors 311 and 311' embedded in the body 50 may be increased by extending the distance between the first bent portions 311*a* and 311*a'* and the second bent portions 311*b* and 311*b'*.

Further, the detailed shape, angle, number and the like of the bent portions are not particularly limited. The bent portions may be provided as a plurality of bent portions to increase a contact area between the connection portions 31 and 32 and the body 50.

In this embodiment, the end of the coil portion 42 and the plurality of connecting conductors 311 and 311' may be connected to each other and integrally formed. The first lead-out portion 62 may be connected to the first connection portion 31 extending from an end of the first coil portion 42, and the second lead-out portion 64 may be connected to the second connection portion 32 extending from an end of the second coil portion 44. As an example, the plurality of connecting conductors 311, 311', 321 and 321' may be spaced apart from each other by a predetermined distance and may extend to ends of the coil portions 42 and 44, respectively.

The plurality of connecting conductors 311, 311', 321 and 321' constituting the connection portions 31 and 32 may be manufactured by a patterning and etching process known in the art, and may also be naturally formed in the process of forming the coil portions 42 and 44 by plating or the like. As an example, the coil portions 42 and 44, the lead-out portions 62 and 64, the connection portions 31 and 32, and the plurality of connecting conductors 311, 311', 321 and 321' may be formed without separating the processes by placing a different material in a region except for regions in which the coil portions 42 and 44, the lead-out portions 62 and 64, the connection portions 31 and 32, and the plurality of connecting conductors 311, 311', 321 and 321' are to be formed. In this case, a plating resist for formation of the coil portions 42 and 44, the connection portions 31 and 32, and the lead-out portions 62 and 64 is integrally formed, such that the plurality of connecting conductors 311, 311', 321 and 321' and the lead-out portions 62 and 64 may be plated together when the coil portions 42 and 44 are plated. In the case of forming the coil portions 42 and 44 and the lead-out portions 62 and 64 by performing the plating process, the thickness of the lead-out portions 62 and 64 may be appropriately adjusted by adjusting a current density, the concentration of a plating liquid, a plating speed, or the like. The connection portions 31 and 32 and the plurality of connecting conductors 311, 311', 321 and 321' may be obtained by various methods in addition to the method proposed in this embodiment.

The coil portions 42 and 44, the lead-out portions 62 and 64, the plurality of connecting conductors 311, 311', 321 and 321' and the via electrodes (not illustrated) may be respectively formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Referring to FIGS. 1 and 2, the end of the coil portion 42, the plurality of connecting conductors 311 and 311', and the lead-out portions 62 are connected to each other to form a closed loop. As an example, the end of the first coil portion 42, the plurality of first connecting conductors 311 and 311', and the first lead-out portion 62 are integrally connected to form one loop having an inner space therein. Although a detailed shape of the loop is not particularly limited, the loop may be a closed loop to have a region filled with a magnetic material therein. As described above, an internal portion of the closed loop may be filled with a magnetic material. As a result, inductance may be secured and coupling force between the body 50 and the connection portions 31 and 32 may also be increased.

Referring to FIGS. 1 and 2, the external electrodes 81 and 82 are disposed on surfaces of the body 50 to cover the lead-out portions 62 and 64, respectively. According to this embodiment, the external electrodes 81 and 82 may be disposed to partially extend to the first surface 101 and the second surface 102 of the body 50 and the third surface 103 and the fourth surface 104 of the body 50, connecting the first and second surfaces 101 and 102 to each other, to cover the lead-out portions 62 and 64.

The external electrodes 81 and 82 may be formed by a thin film process such as a sputtering process. The external electrodes 81 and 82 may include at least one of copper (Cu), aluminum (Al), silver (Ag), tin (Sn), gold (Au), nickel (Ni), lead (Pb), chromium (Cr), titanium (Ti), and alloys thereof, as a conductive material, and may be implemented to have a multilayer structure.

Second Embodiment

Figure 3:
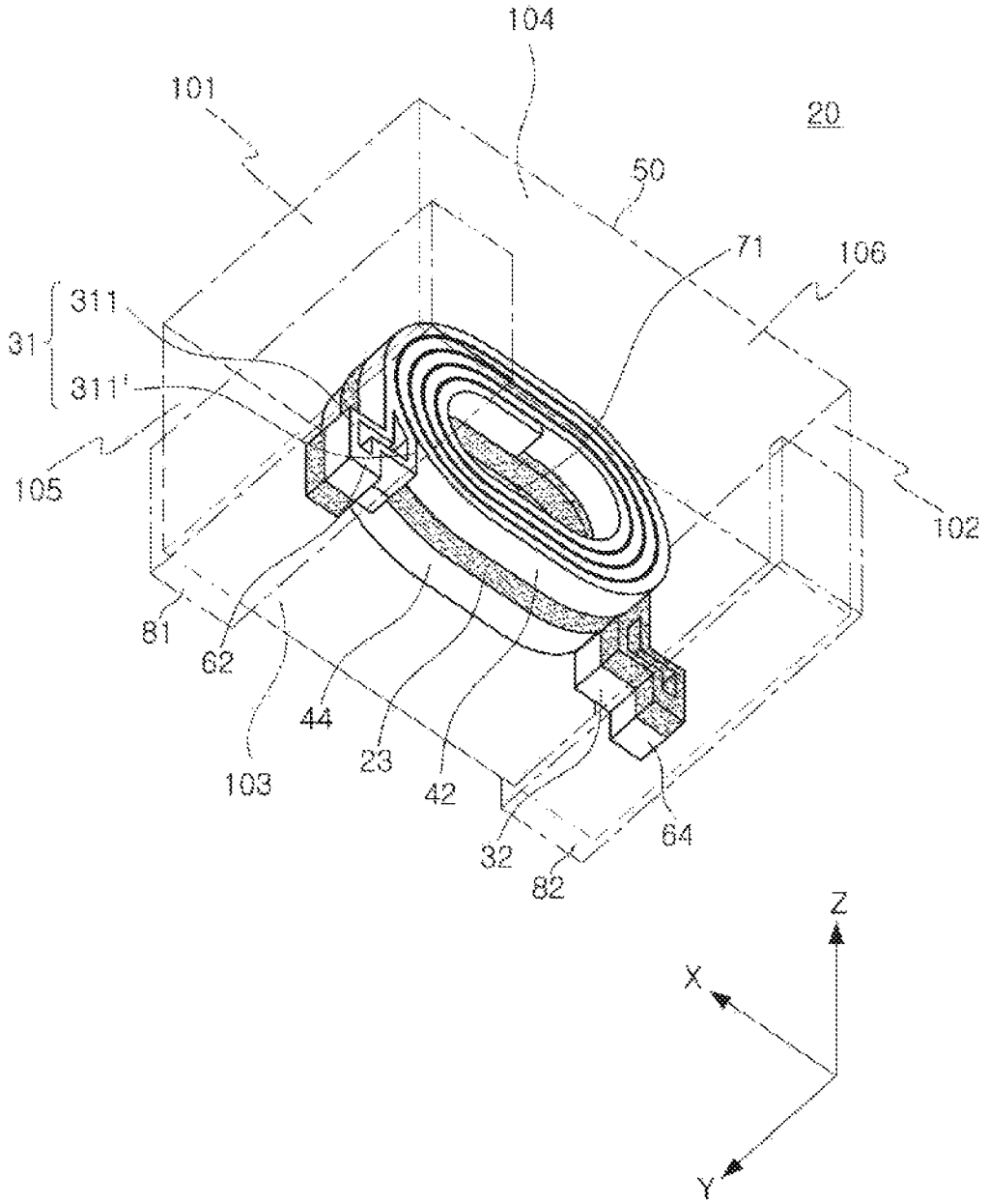
FIG. 3 is a view of a coil electronic component according to a second embodiment, viewed from below.
Figure 4:
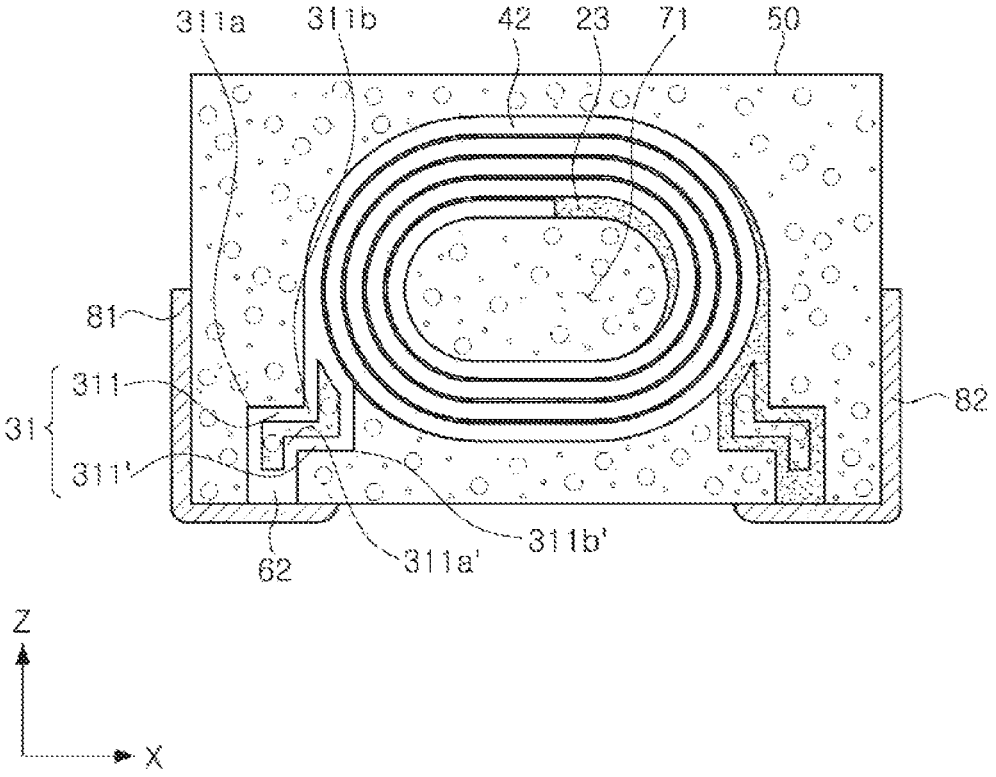
FIG. 4 is a view illustrating overlapping coil portions of the coil electronic component of FIG. 3.

FIG. 3 is a view of a coil electronic component according to a second embodiment, viewed from below. FIG. 4 is a view illustrating overlapping coil portions of the coil electronic component of FIG. 3.

Referring to FIGS. 3 and 4, when compared to the coil electronic component 10 according to the first embodiment, the arrangement of coil portions 42 and 44, connection portions 31 and 32, lead-out portions 62 and 64, and external electrodes 81 and 82 is different. Therefore, in describing a coil electronic component 20 according to the second embodiment, only the arrangement of the coil portions 42 and 44, the connection portions 31 and 32, the lead-out portions 62 and 64, and the external electrodes 81 and 82 different from those of the first embodiment will be described. Descriptions of remaining configurations in this embodiment may be substituted with the descriptions of the first embodiment.

Referring to FIGS. 3 and 4, the coil portions 42 and 44 may be formed to be upright with respect to the third surface 103 or the fourth surface 104 of the body 50.

The term "formed to be upright with respect to the third surface 103 or the fourth surface 104 of the body 50" refers to surfaces of the coil portions 42 and 44, contacting the insulating substrate 23 as illustrated in FIG. 3, being formed perpendicularly to or almost perpendicular to the third surface 103 or the fourth surface 104 of the body 50. For example, the coil portions 42 and 44 and the third surface 103 or the fourth surface 104 of the body 50 may be formed upright at 80 to 100°.

The coil portions 42 and 44 may be formed to be parallel to the fifth surface 105 and the sixth surface 106 of the body 50. For example, the surfaces of the coil portions 42 and 44, contacting the insulating substrate 23, may be parallel to the fifth surface 105 and the sixth surface 106 of the body 50.

As the body 50 is downsized to a size of 1608 or 1006 or less, the body 50 is formed to have a thickness greater than a width, and a cross-sectional area of an X-Z direction cross section of the body 50 is larger than a cross-sectional area of an X-Y direction cross-section. Thus, as the coil portions 42 and 44 are formed upright with respect to the third surface 103 or the fourth surface 104 of the body 50, an area in which the coil portions 42 and 44 may be formed increases.

For example, when the length of the body 50 is 1.6±0.2 mm and the width of the body 50 is 0.8±0.05 mm, the thickness may satisfy the range of 1.0±0.05 mm (1608 size). Further, when the length of the body 50 is 0.2±0.1 mm and the width of the body 50 is 0.25±0.1 mm, the thickness may satisfy the range of up to 0.4 mm (1006 size). Thus, since the thickness is greater than the width, when the coil portions 42 and 44 are formed vertically with respect to the third surface 103 or the fourth surface 104 of the body 50, a relatively large area may be secured, as compared with a case in which the coil portions 42 and 44 are formed horizontally with respect to the third surface 103 or the fourth surface 104 of the body 50. As the area in which the coil portions 42 and 44 are formed is increased, the inductance L and the quality factor Q may be improved.

Referring to FIG. 4, a first bent portion 311*a* of a first connecting conductor 311 corresponds to a first bent portion 311*a*' of a first connecting conductor 311' that is point symmetrical thereto, and similarly, second bent portions 311*b* and 311*b*' may also be formed on positions of the first connecting conductors 311 and 311', corresponding to each other.

The shape of a plurality of the connecting conductors 311 and 311' constituting a connection portion 31 is not particularly limited, and for example, may have a shape to secure structural rigidity between the coil portions 42 and 44 and the external electrodes 81 and 82. As an example, the first connecting conductors 311 and 311' may have a step shape in which they correspond to each other, by the first bent portions 311*a* and 311*a*' and the second bent portions 311*b* and 311*b*'. Accordingly, a distance between the first bent portions 311*a* and 311*a*' may be substantially the same as a distance between the second bent portions 311*b* and 311*b*' in the width direction Y. In detail, by forming the first bent portions 311*a* and 311*a*' on an outer side of the body in the length direction X, the length of the first connecting conductors 311 and 311' embedded in the body 50 may be increased.

According to this embodiment, the body 50 includes first and second surfaces 101 and 102 opposing each other, the third surface 103 and the fourth surface 104 connecting the first and second surfaces 101 and 102, and the lead-out portions 62 and 64 may be exposed to the third surface 103 of the body 50. Referring to FIGS. 3 and 4, the lead-out portions 62 and 64 are exposed to the third surface 103 of the body 50, but are not limited thereto, may be exposed to the fourth surface 104.

According to this embodiment, the external electrodes 81 and 82 are disposed on the third surface 103 or the fourth surface 104 of the body to cover the lead-out portions 62 and 64, respectively, and may partially extend to the first and second surfaces 101 and 102, respectively.

Referring to FIGS. 3 and 4, the external electrodes 81 and 82 may be narrower than the width of the body 50. The first external electrode 81 may cover the first lead-out portion 62 and extend from the third surface 103 of the body 50 to be disposed on the first surface 101, but is not disposed on the fifth surface 105 and the sixth surface 106 of the body 50. The second external electrode 82 may cover the second lead-out portion 64 and extend from the third surface 103 of the body 50 to be disposed on the second surface 102, but is not disposed on the fifth surface 105 and the sixth surface 106 of the body 50.

Third Embodiment

Figure 5:
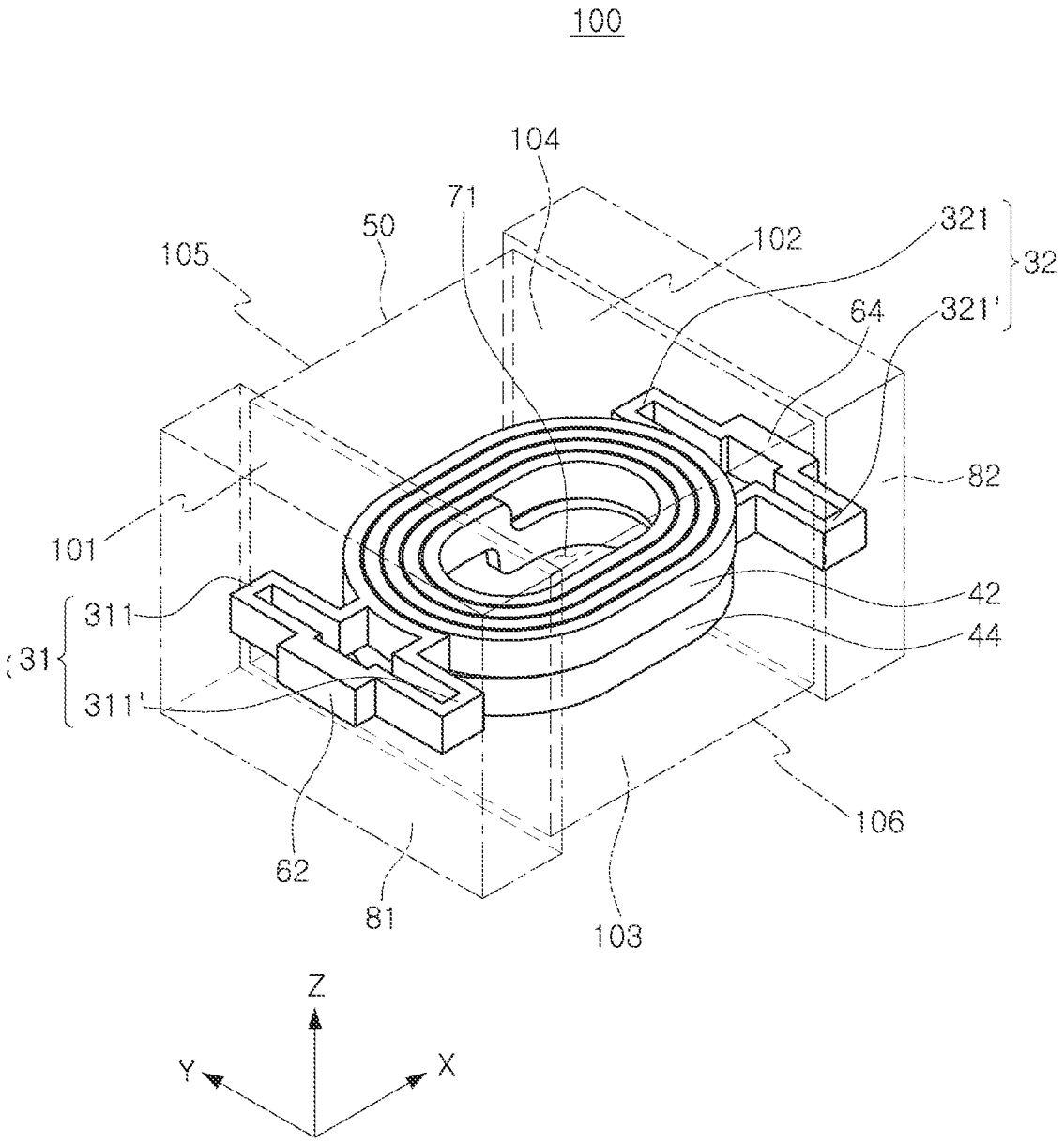
FIG. 5 is a perspective view schematically illustrating a coil electronic component according to a third embodiment of the present disclosure.
Figure 6:
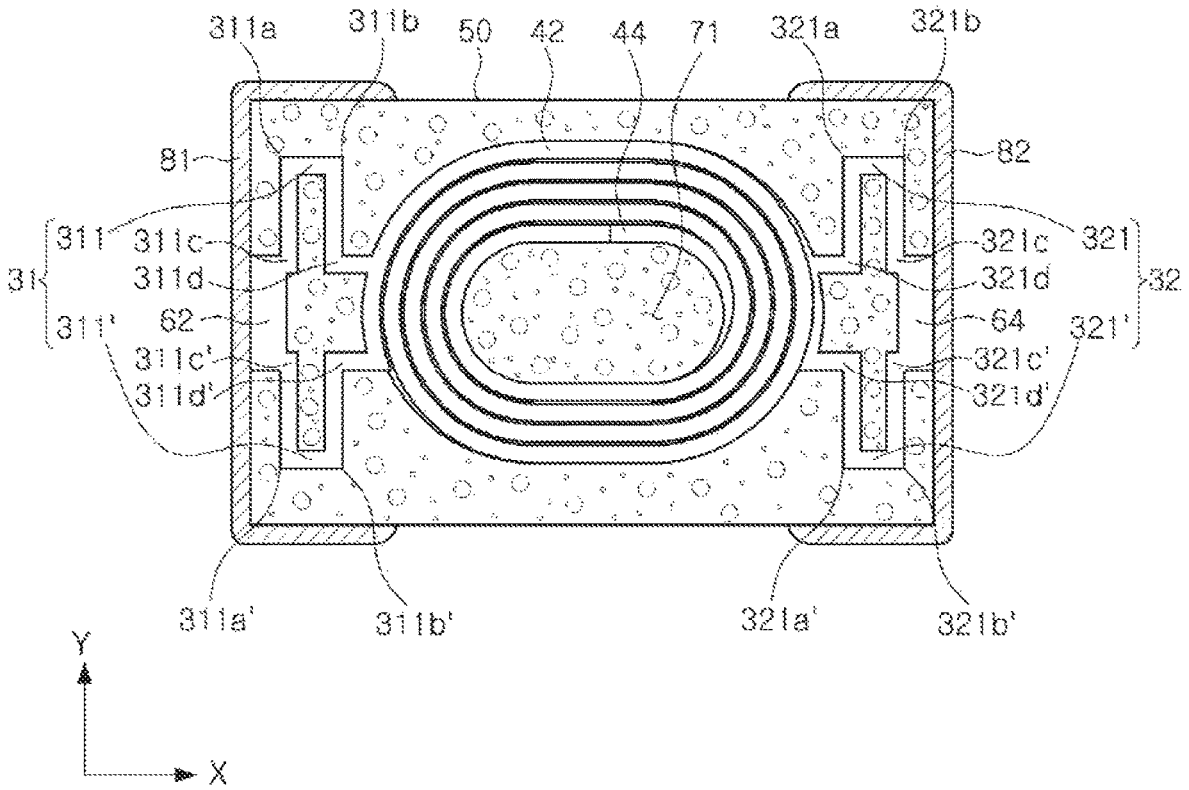
FIG. 6 is a diagram illustrating coil portions of the coil electronic component of FIG. 5, overlapping each other.

FIG. 5 is a perspective view schematically illustrating a coil electronic component according to a third embodiment. FIG. 6 is a diagram illustrating coil portions of the coil electronic component of FIG. 5, overlapping each other.

Referring to FIGS. 5 and 6, the presence of the winding coil is different compared to the coil electronic component 10 according to the first embodiment. Therefore, in the description of a coil electronic component 100 according to the third embodiment, only a winding coil different from the first embodiment will be described. Descriptions of remaining configurations in this embodiment may be substituted with the descriptions of the first embodiment.

Referring to FIGS. 5 and 6, the coil electronic component 100 according to the third embodiment may include a body 50, winding coils 42 and 44, lead-out portions 62 and 64, and connection portions 31 and 32.

Referring to FIGS. 5 and 6, the winding coils 42 and 44 are embedded in the body 50. The winding coils 42 and 44 may be formed by winding a metal wire such as a copper (Cu) wire having a surface coated with an insulating material in a spiral shape. In addition, the lead-out portions 62 and 64 are connected to the winding coils 42 and 44, to be exposed to the surface of the body 50. The winding coils (42 and 44) include a first coil portion 42 connected to the first lead-out portion 62, and a second coil portion 44 connected to the second lead-out portion 64 and positioned below the first coil portion 42. For example, ends of the winding coils 42 and 44 refer to an end of the first coil portion 42 connected to the first lead-out portion 62, and an end of the second coil portion 44 connected to the second lead-out portion 64, respectively. In detail, the first coil portion 42 is spirally formed from the first lead-out portion 62 to be connected to the second coil portion 44 provided therebelow, and the second coil portion 44 is spirally formed to be connected to the lead-out portion 64. In addition, the first lead-out portion 62 is exposed to the first surface 101 of the body 50 to be connected to the first external electrode 81, and the second lead-out portion 64 is exposed to the second surface 102 of the body 50 to be connected the second external electrode 82.

Referring to FIGS. 5 and 6, the connection portions 31 and 32 are configured to connect the ends of the winding coils 42 and 44 to the lead-out portions 62 and 64, and are provided with bent portions in such a manner that lengths of the winding coils 42 and 44 embedded in the body 50 are increased. For example, the connection portion 31 has a length greater than a distance from the lead-out portion 62 to the winding coil 42 along a straight line, and the connection portion 32 has a length greater than a distance from the lead-out portion 64 to the winding coil 44 along a straight line. In detail, a first connection portion 31 connects the end of the first coil portion 42 and the first lead-out portion 62, and a second connection portion 32 connects the end of the second coil portion 44 and the lead-out portion 64. The connection portions 31 and 32 may include a plurality of connecting conductors 311, 311', 321 and 321' spaced apart from each other, respectively. Connection reliability between the winding coils 42 and 44 and the external electrodes 81 and 82 may be improved by the plurality of connecting conductors 311, 311', 321 and 321'. In addition, inductance may be further secured as regions in which the plurality of connecting conductors 311, 311', 312 and 312' are spaced apart from each other may be filled with a magnetic material of the body 50.

The ends of the winding coils 42 and 44 are connected to the plurality of connecting conductors 311, 311', 321 and 321' to be integrally formed with each other. In the process of winding a metal wire in a spiral shape, the lead-out portions 62 and 64 are connected to the connection portions 31 and 32 extending from the ends of the winding coils 42 and 44, respectively, and thus may be integrally formed.

The ends of the winding coils 42 and 44, the plurality of connecting conductors 311, 311', 321 and 321' and the lead-out portions 62 and 64 are connected to each other to form a closed loop. The ends of the winding coils 42 and 44, the plurality of connecting conductors 311, 311', 321 and 321' and the lead-out portions 62 and 64 may be integrally connected to form a single loop.

Fourth Embodiment

Figure 7:
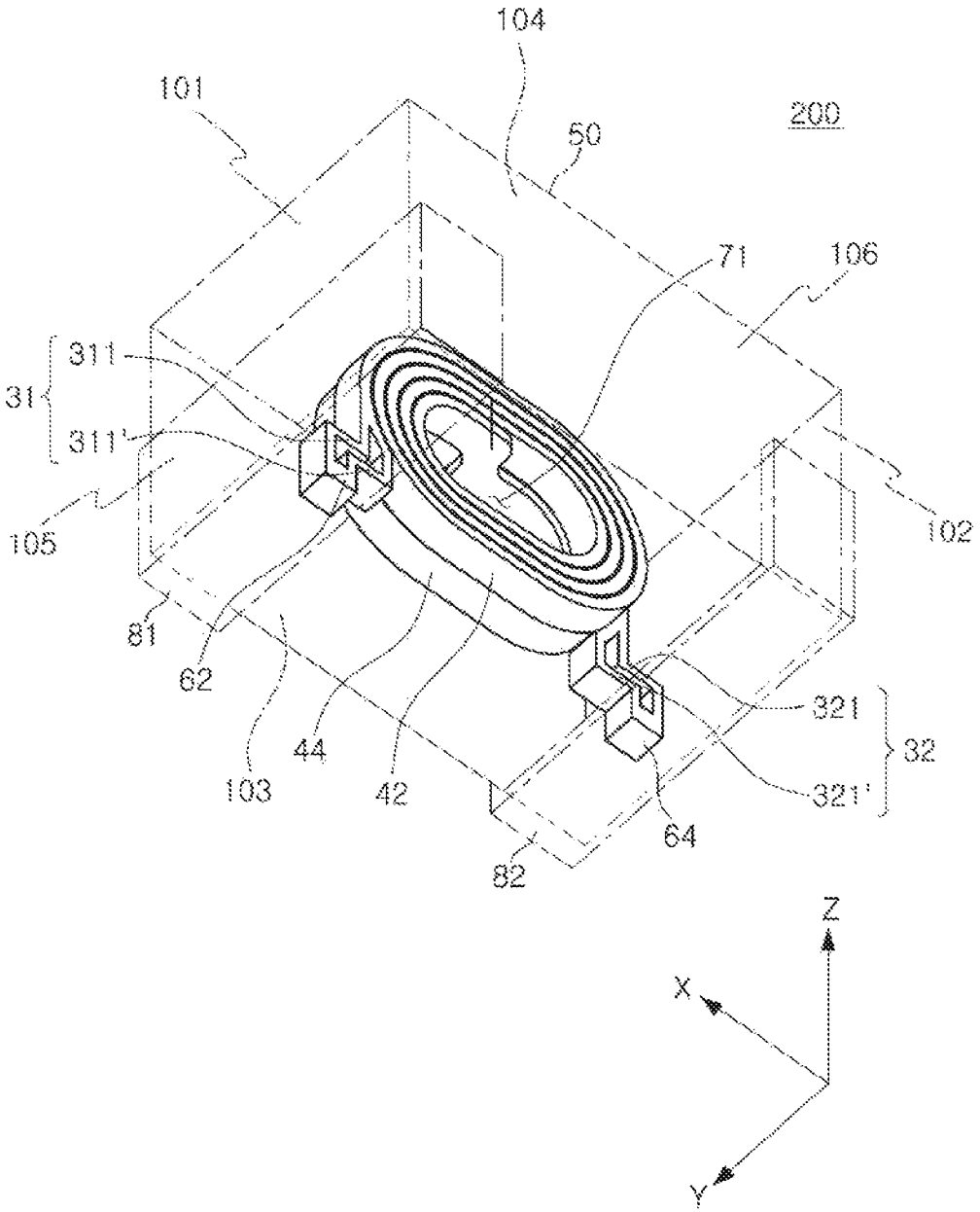
FIG. 7 is a view of a coil electronic component according to a fourth embodiment of the present disclosure, viewed from below.
Figure 8:
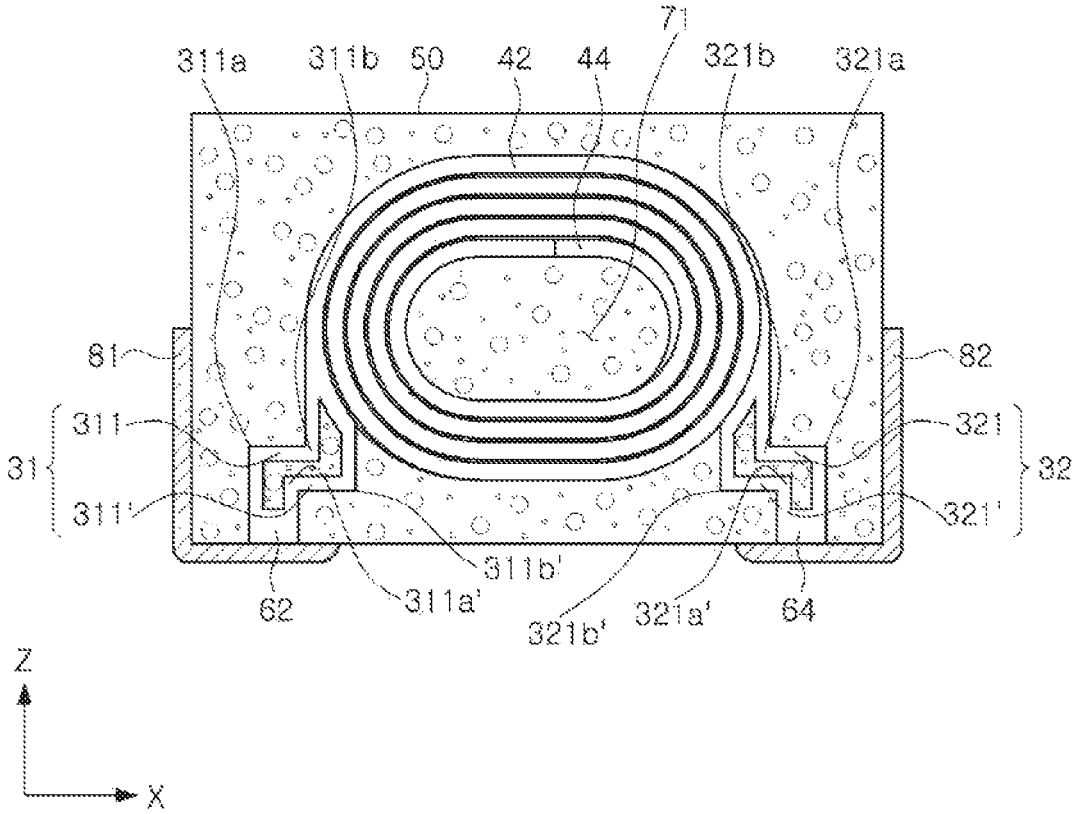
FIG. 8 is a diagram illustrating coil portions of the coil electronic component of FIG. 7, overlapping each other.

FIG. 7 is a view of a coil electronic component according to a fourth embodiment, viewed from below. FIG. 8 is a view illustrating coil portions of the coil electronic component of FIG. 7, overlapping each other.

Referring to FIGS. 7 and 8, when compared to the coil electronic component 100 according to the third embodiment, the arrangement of winding coils 42 and 44, connection portions 31 and 32, lead-out portions 62 and 64, and external electrodes 81 and 82 is different. Therefore, in describing a coil electronic component 200 according to the fourth embodiment, only the arrangement of the winding coils 42 and 44, the connection portions 31 and 32, the lead-out portions 62 and 64, and the external electrodes 81 and 82 different from those of the third embodiment will be described. Descriptions of remaining configurations of this embodiment may be substituted with the descriptions of the third embodiment.

Referring to FIGS. 7 and 8, the coil portions 42 and 44 may be formed to be upright with respect to the third surface 103 or the fourth surface 104 of the body 50.

The term "formed to be upright with respect to the third surface 103 or the fourth surface 104 of the body 50" indicates that the winding coils 42 and 44 are formed perpendicularly to or almost perpendicular to the third surface 103 or the fourth surface 104 of the body 50 as illustrated in FIG. 3. For example, the winding coils 42 and 44 and the third surface 103 or the fourth surface 104 of the body 50 may be formed upright at 80 to 100°.

The winding coils 42 and 44 may be formed to be parallel to the fifth surface 105 and the sixth surface 106 of the body 50.

As the body 50 is downsized to a size of 1608 or 1006 or less, the body 50 is formed to have a thickness greater than a width, and a cross-sectional area of an X-Z direction cross section of the body 50 is larger than a cross-sectional area of an X-Y direction cross-section. Thus, as the winding coils 42 and 44 are formed upright with respect to the third surface 103 or the fourth surface 104 of the body 50, an area in which the winding coils 42 and 44 may be formed increases.

For example, when the length of the body 50 is 1.6±0.2 mm and the width of the body 50 is 0.8±0.05 mm, the thickness may satisfy the range of 1.0±0.05 mm (1608 size). Further, when the length of the body 50 is 0.2±0.1 mm and the width of the body 50 is 0.25±0.1 mm, the thickness may satisfy the range of up to 0.4 mm (1006 size). Thus, since the thickness is greater than the width, when the winding coils 42 and 44 are formed vertically with respect to the third surface 103 or the fourth surface 104 of the body 50, a relatively large area may be secured, as compared with a case in which the winding coils 42 and 44 are formed horizontally with respect to the third surface 103 or the fourth surface 104 of the body 50. As the area in which the winding coils 42 and 44 are formed is increased, the inductance L and the quality factor Q may be improved.

Referring to FIG. 8, a first bent portion 311*a* of a first connecting conductor 311 corresponds to a first bent portion 311*a'* of a first connecting conductor 311' that corresponds to the first connecting conductor 311, and similarly, second bent portions 311*b* and 311*b'* may also be formed on positions of the first connecting conductors 311 and 311', corresponding to each other.

The shape of a plurality of the connecting conductors 311 and 311' constituting a connection portion 31 is not particularly limited, and for example, may have a shape to secure structural rigidity between the coil portions 42 and 44 and the external electrodes 81 and 82. As an example, the first connecting conductors 311 and 311' may have a step shape in which they correspond to each other, by the first bent portions 311*a* and 311*a'* and the second bent portions 311*b* and 311*b'*. Accordingly, a distance between the first bent portions 311*a* and 311*a'* may be substantially the same as a distance between the second bent portions 311*b* and 311*b'* in the width direction Y. In detail, by forming the first bent portions 311*a* and 311*a'* on an outer side of the body in the length direction X, the length of the first connecting conductors 311 and 311' embedded in the body 50 may be increased.

According to this embodiment, the body 50 includes first and second surfaces 101 and 102 opposing each other, and third and fourth surfaces 103 and 104 connecting the first and second surfaces 101 and 102, and the lead-out portions 62 and 64 may be exposed to the third surface 103 or the fourth surface 104 of the body 50. Referring to FIGS. 7 and 8, the lead-out portions 62 and 64 are exposed to the third surface 103 of the body 50, but are not limited thereto. For example, the lead-out portions 62 and 64 may be exposed to the third surface 103 or the fourth surface 104.

According to this embodiment, the external electrodes 81 and 82 are disposed on the first and second surfaces 101 and 102 of the body and partially extend to the third surface 103 or the fourth surface 104 of the body, connecting the first and second surfaces 101 and 102, to cover the lead-out portions 62 and 64, respectively.

Referring to FIGS. 7 and 8, the external electrodes 81 and 82 may be disposed to be narrower than the width of the body 50. The first external electrode 81 may be cover the first lead-out portion 62 and extend from the first surface 101 of the body 50 to be disposed on the third surface 103, but is not disposed on the fifth surface 105 and the sixth surface 106 of the body 50. The second external electrode 82 may cover the second lead-out portion 64 and extend from the second surface 102 of the body 50 to be disposed on the third surface 103, but is not disposed on the fifth surface 105 and the sixth surface 106 of the body 50.

As set forth above, in a coil electronic component according to an embodiment, connection reliability and structural rigidity of a portion in which a coil portion and an external electrode are connected may be increased.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil electronic component comprising:

an insulating substrate;

a coil portion disposed on at least one surface of the insulating substrate;

a body in which the insulating substrate and the coil portion are embedded;

a first lead-out portion and a second lead-out portion connected to the coil portion and exposed from the body, the first lead-out portion and the second lead-out portion being spaced apart from each other; and a first connection portion including a plurality of first connecting conductors each having a bent portion embedded in the body, the plurality of first connecting conductors being spaced apart from each other and extending between an end of the coil portion and the first lead-out portion, wherein the end of the coil portion, the plurality of first connecting conductors and the first lead-out portion are connected to each other to have a closed loop.

2. The coil electronic component of claim 1, wherein the plurality of first connecting conductors comprise at least one corner portion formed by the bent portion.

3. The coil electronic component of claim 1, wherein the bent portion is disposed in positions, corresponding to each other, of the plurality of first connecting conductors, respectively.

4. The coil electronic component of claim 1, wherein the end of the coil portion and the plurality of first connecting conductors are connected to each other and integrally provided with each other.

5. The coil electronic component of claim 1, wherein an internal space in the closed loop is filled with a magnetic material.

6. The coil electronic component of claim 1, wherein the body comprises a first surface and a second surface opposing each other, and a third surface connecting the first and second surfaces to each other, and the first lead-out portion is exposed to the third surface of the body.

7. The coil electronic component of claim 1, further comprising:

a first electrode disposed on the body to cover the first lead-out portion; and a second electrode disposed on the body to cover the second lead-out portion.

8. The coil electronic component of claim 1, wherein each of the plurality of first connecting conductors has a length greater than a distance from the first lead-out portion to the coil portion.

9. The coil electronic component of claim 1, further comprising:

a second connection portion including a plurality of second connecting conductors each having a bent portion embedded in the body, the plurality of second connecting conductors being spaced apart from each other and extending between another end of the coil portion and the second lead-out portion.

10. The coil electronic component of claim 9, wherein the body comprises a first surface and a second surface opposing each other, and a third surface connecting the first and second surfaces to each other, and the first lead-out portion is exposed to the third surface of the body, and the second lead-out portion is exposed to the third surface of the body.

11. The coil electronic component of claim 9, wherein the body comprises a first surface and a second surface opposing each other, and a third surface connecting the first and second surfaces to each other, and the first lead-out portion is exposed to the first surface of the body, and the second lead-out portion is exposed to the second surface of the body.

* * * * *